United States Patent [19]

Fish et al.

[11] 4,180,182

[45] Dec. 25, 1979

[54] DISPENSING MAGAZINE

[75] Inventors: Leonard A. Fish, Chicago; Duane M. Mills, Western Springs, both of Ill.

[73] Assignee: Bank Computer Network Corporation, Schiller Park, Ill.

[21] Appl. No.: 744,381

[22] Filed: Nov. 23, 1976

[51] Int. Cl.[2] ..... G07F 11/36

[52] U.S. Cl. ..... 221/75; 221/312 A; 194/DIG. 26

[58] Field of Search ..... 221/75, 312 A, 13, 225, 221/236, 224, 256, 99, 131; 194/DIG. 26; 24/67.11; 85/1 L; 198/473, 475, 664, 661, 685, 792, 459; 222/412, 413, 414

[56] References Cited

U.S. PATENT DOCUMENTS

| | | | |
|---|---|---|---|
| 841,083 | 1/1907 | Garson | 221/236 X |
| 1,301,301 | 4/1919 | Nishioka | 221/99 X |
| 1,851,770 | 3/1932 | Johnson | 24/67.11 X |
| 3,185,851 | 5/1965 | D'Emilio | 221/13 X |
| 3,464,588 | 9/1969 | Strike et al. | 221/75 |
| 4,044,890 | 8/1977 | Kramming | 221/312 A X |

FOREIGN PATENT DOCUMENTS

| | | | |
|---|---|---|---|
| 641767 | 5/1962 | Canada | 85/1 L |
| 738830 | 7/1966 | Canada | 221/75 |
| 1140386 | 11/1962 | Fed. Rep. of Germany | 221/75 |
| 2164442 | 6/1973 | Fed. Rep. of Germany | 221/75 |
| 1464301 | 11/1966 | France | 221/75 |

*Primary Examiner*—Robert J. Spar
*Assistant Examiner*—Edward M. Wacyra
*Attorney, Agent, or Firm*—Hill, Van Santen, Steadman, Chiara & Simpson

[57] ABSTRACT

In a dispensing machine, a magazine is provided in which a multiplicity of packets to be dispensed are maintained in a magazine supported by clips which support the packets on a helical screw. The packets are dispensed individually by energizing a motor to turn the screw, during which the endmost packet drops into a receiving tray. The drop of the packet is detected by a photosensitive detector, and the screw driving motor is deenergized. The magazine contains a channel for maintaining the packets in single-file relationship as they are advanced toward the end of the screw in response to rotation of the screw. The tray into which the packets are dropped is slidable between an inner position, in which it is disposed below the dispensing magazine, and an outer position in which the contents of the tray are accessible to an operator. The tray is forced toward an outer position, and a motorized drive is provided for moving the tray backwardly and forwardly when the tray is in a rearward position.

12 Claims, 10 Drawing Figures

DISPENSING MAGAZINE

BACKGROUND

1. Field of the Invention

The present invention relates to a dispensing magazine and, more particularly, to a magazine adapted to hold and dispense packets of cash in a cash dispensing machine.

2. The Prior Art

Cash dispensing machines in the prior art have employed a variety of magazines for holding the cash to be dispensed, which magazines are relatively complex and clumsy and typically require special cartridges or containers for holding and transporting individual packets of money to be dispensed by the machine.

It is essential that the packets of cash be dispensed one by one, and the means for insuring that the one at a time operation takes place requires a complex assembly. It is also necessary to load the packets to be dispensed into a magazine in a particular manner, which is a time consuming task.

BRIEF SUMMARY OF THE PRESENT INVENTION

It is a principal object of the present invention to provide a magazine assembly for a dispensing machine in which packets or articles are dispensed in one at a time fashion, and which is capable of being loaded simply and easily without any rigid orientation of the packets.

Another object of the present invention is to provide a simple and economical apparatus and method for storing and dispensing packets of cash.

Another object of the present invention is to provide a magazine for a cash dispenser which may be quickly and easily loaded with packets of cash, and in which no special cartridges or containers are required for the individual cash packets.

A further object of the present invention is to provide a magazine for a cash dispensing machine in which a multiplicity of packets of cash may be loaded without any individual attention to the individual location of each packet, but with means for insuring that the packets are dispensed one at a time, each time a dispensing operation is properly called for by a user.

Another feature of the present invention is to provide a cash dispensing machine with a drawer for accepting deposit items and for making available to the user dispense packets of cash, with motorized means for moving a drawer between an inner position, in which it receives a dispensed packet of cash, and an outer position, in which the packet is accessible to the user.

Another object of the present invention is to provide such a drawer with means for resiliently urging the drawer toward its outer position, until a user manually pushes the drawer inwardly far enough to insure that his fingers cannot be caught in the drawer.

These and other objects and advantages of the present invention will become manifest by an examination of the following description and the accompanying drawings.

In one embodiment of the present invention, there is provided a magazine for a cash dispensing machine comprising a screw supported at one end and having a helical thread, and a plurality of packets each supported from said screw by a hook, said thread having a first portion of one pitch and a second portion of another pitch, said second portion having flattened threads, whereby said hooks are separated so as to individually reside between adjacent convolutions of the screw at the free end thereof.

BRIEF DESCRIPTION OF THE DRAWINGS

Reference will now be made to the accompanying drawings, in which.

DESCRIPTION OF THE PREFERRED EMBODIMENT

Figure 1:
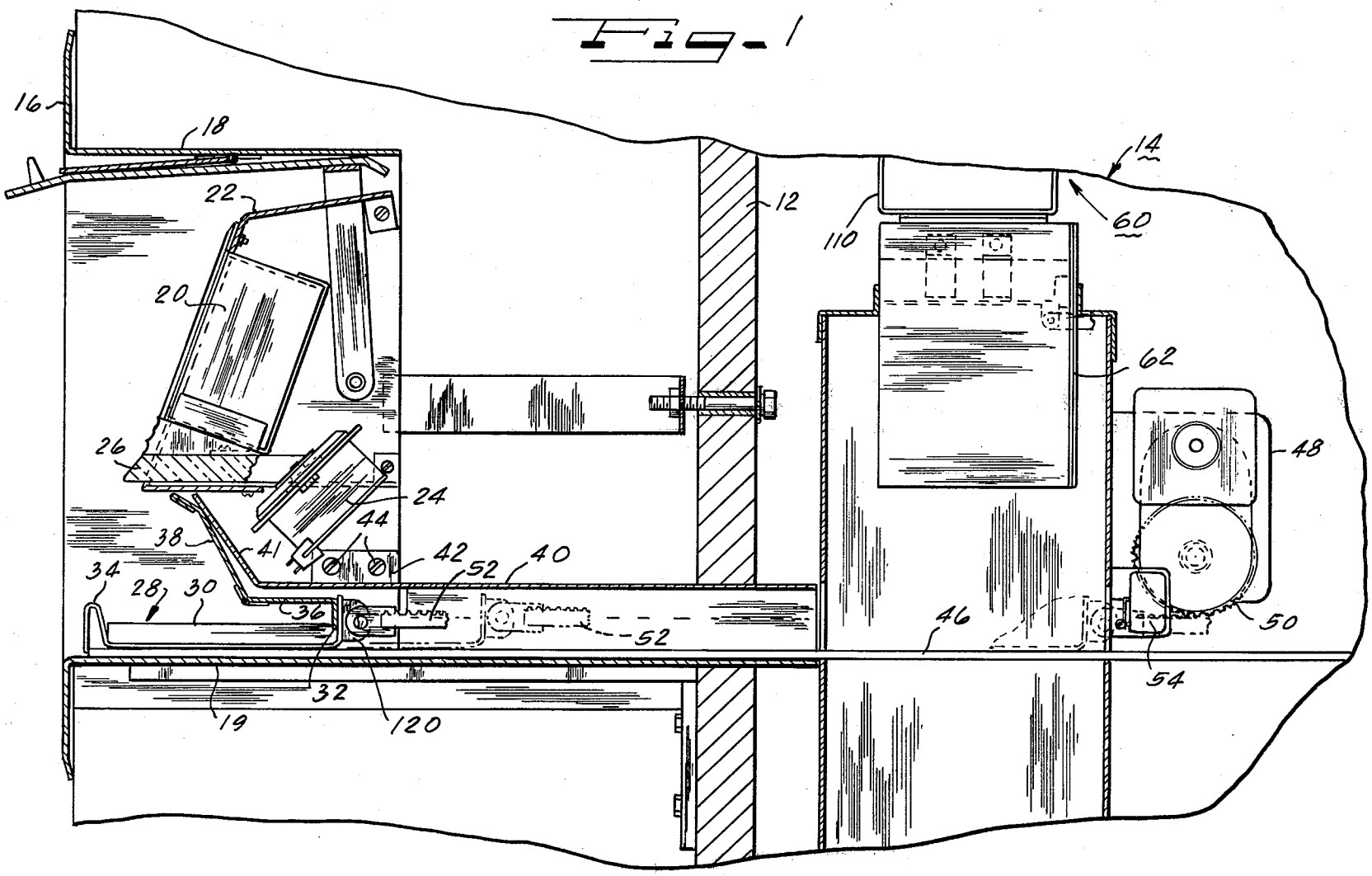
FIG. 1 is a side elevation, partly in cross-section, of a cash dispensing machine incorporating an illustrative embodiment of the present invention.

Referring first to FIG. 1, a cash dispenser machine incorporated in an illustrative embodiment of the present invention is illustrated in cross-sectional form. It incorporates a frame which supports exterior and interior walls to form a supporting structure and a casing surrounding the unit. One of the interior vertical walls 12 is shown in FIG. 1 and, as illustrated therein, is formed of relatively thick material, preferably steel, to provide security for the cash dispensing magazine section 14. An exterior wall 16 is part of the outer casing. At the front of the machine, the wall 16 is provided with a recess defined by an upper wall 18 and a lower wall 19, for housing some of the operating components of the machine in a position spaced inwardly from the outer wall 16. The operating elements include a keyboard mechanism 20 supported on a bracket 22, by which instructions and data may be entered into the machine by an operator. Within the recess is also located a display unit 24, which, in the embodiment illustrated in FIG. 1, is viewed by an operator standing before the front wall 16 through a prism 26. The display device 24 and the prism 26 are supported on the frame by suitable brackets (not shown). A drawer unit 28 is supported just above the bottom wall 19 of the front recess, and is arranged for movement in a direction inwardly from the position shown in FIG. 1, which is the outermost position which may be occupied by the drawer. The drawer 28 is shaped in the manner of a tray with two side walls 30, one of which is shown in FIG. 1, a rear wall 32, and a forward wall 34. The forward wall 34 is preferably bent in a rounded manner at a position above the remainder of the drawer 28, and forms a handle by which the drawer may be pushed inwardly by an operator.

The rear portion of the drawer 28 is provided with a cover 36, and a flap 38 is hinged to the forward part of the cover 36 and urged upwardly relative to the cover 36 by spring means (not shown).

A drawer guide 40, secured to the frame of the machine by a bracket 42 and screws 44, has an upwardly inclined forward extension 41 overlying the drawer 28.

When the drawer is in its outer position as shown in FIG. 1, the flap 38 is in its upward condition, against the extension 41, permitting free access to the contents of the drawer 28. When the drawer 28 is pushed inwardly, however, the flap 38 is closed downwardly against the top of the drawer 28 by means of the guide 40 and its extension 41.

When the drawer 28 is to be pushed into the machine, either to make a deposit or to receive dispensed cash from the magazine unit 14, the forward portion 34 is manually grasped and urged rearwardly toward the interior of the machine. The drawer 28 then slides rearwardly along a pair of guides 46 secured to the frame of the machine, and, as it does so, the upper extremity of the forward wall 34 of the drawer 28 enters the space defined beneath the guide 40. The front wall 34 is arranged to just barely clear beneath the guide 40, so that there is insufficient room for the fingers of an operator to enter the space between the front wall 34 and the guide 40 after the drawer 28 has been pushed inwardly far enough so that the wall 34 underlies the guide 40 behind the extension 41. In order to push the drawer this far inwardly, the operator pushes on the forward portion of the wall 34, and his fingers cannot rise above the upper extremity of the wall 34, or else the drawer cannot move inwardly far enough for the wall 34 to underlie the guide 40.

After the drawer has been manually pushed in so that the wall 34 underlies the guide 40, a motor 48 is adapted to drive the drawer inwardly beyond that position until it gets to a position directly underneath the dispensing unit 14. Alternatively, if the motor is omitted, the drawer is pushed in by hand. The motor is preferably of the type commonly known as a gear motor, and functions to turn a gear 50 which is in engagement with the upper surface of a rack 52. The rack 52 is attached to the drawer 28 at its forward end, so that by driving the rack 52 rearwardly, the drawer 28 is urged rearwardly along the guides 46. A switch (not shown in FIG. 1) senses when the drawer 28 has been pushed in sufficiently far that the wall 34 underlies the guide 40, so that the operator's fingers cannot be caught, and initiates operation of the motor 48. Rearward motion continues until a limit switch 54 senses the presence of the rear end of the drawer, and operates to deenergize the motor 48, leaving the drawer in vertical alignment with the dispensing portion 14 of the machine. When the drawer is to be returned to its outer position, the motor 48 is rotated in its reverse direction, and the gear 50 drives the rack 52 forwardly, urging the drawer toward its outer position. When the drawer moves forwardly far enough that the wall 34 passes out from under the guide 40, the motor 48 is deenergized and the drawer 28 is urged further toward its outermost position by spring means (not shown in FIG. 1). The spring means constantly urges the drawer 28 towards its outer position, so that if it is moved manually inwardly a distance insufficient to initiate operation of the motor 48, the spring means immediately returns the drawer to its outer position, where is remains readily accessible to the user.

Figure 2:
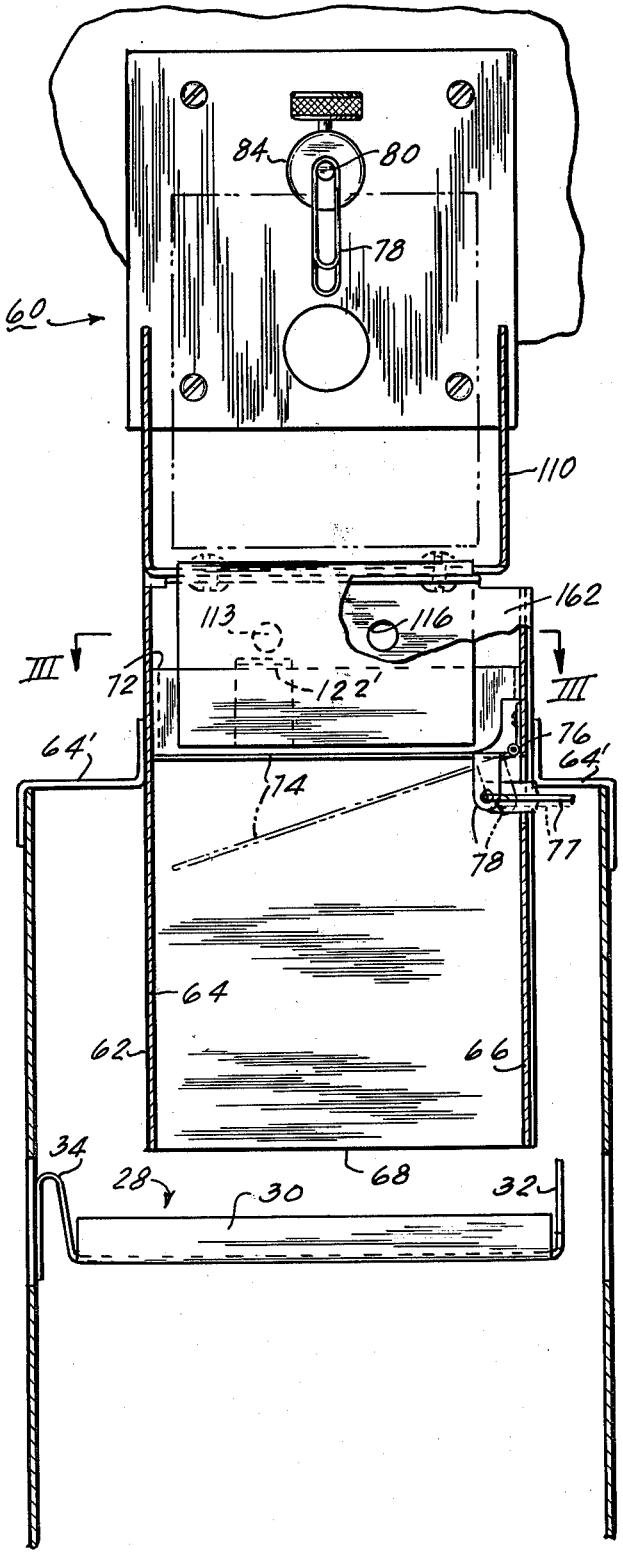
FIG. 2 is a side elevation, partly in cross-section, of a portion of the apparatus illustrated in FIG. 1, shown in greater detail.
Figure 3:
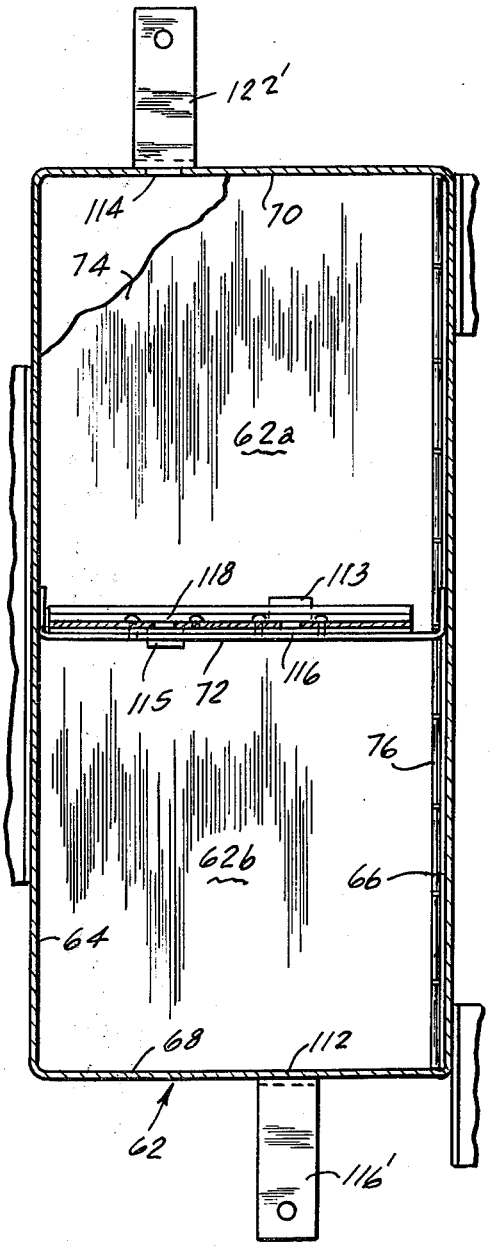
FIG. 3 is a horizontal cross-sectional view of a portion of FIG. 2, taken through the plane III—III.
Figure 4:
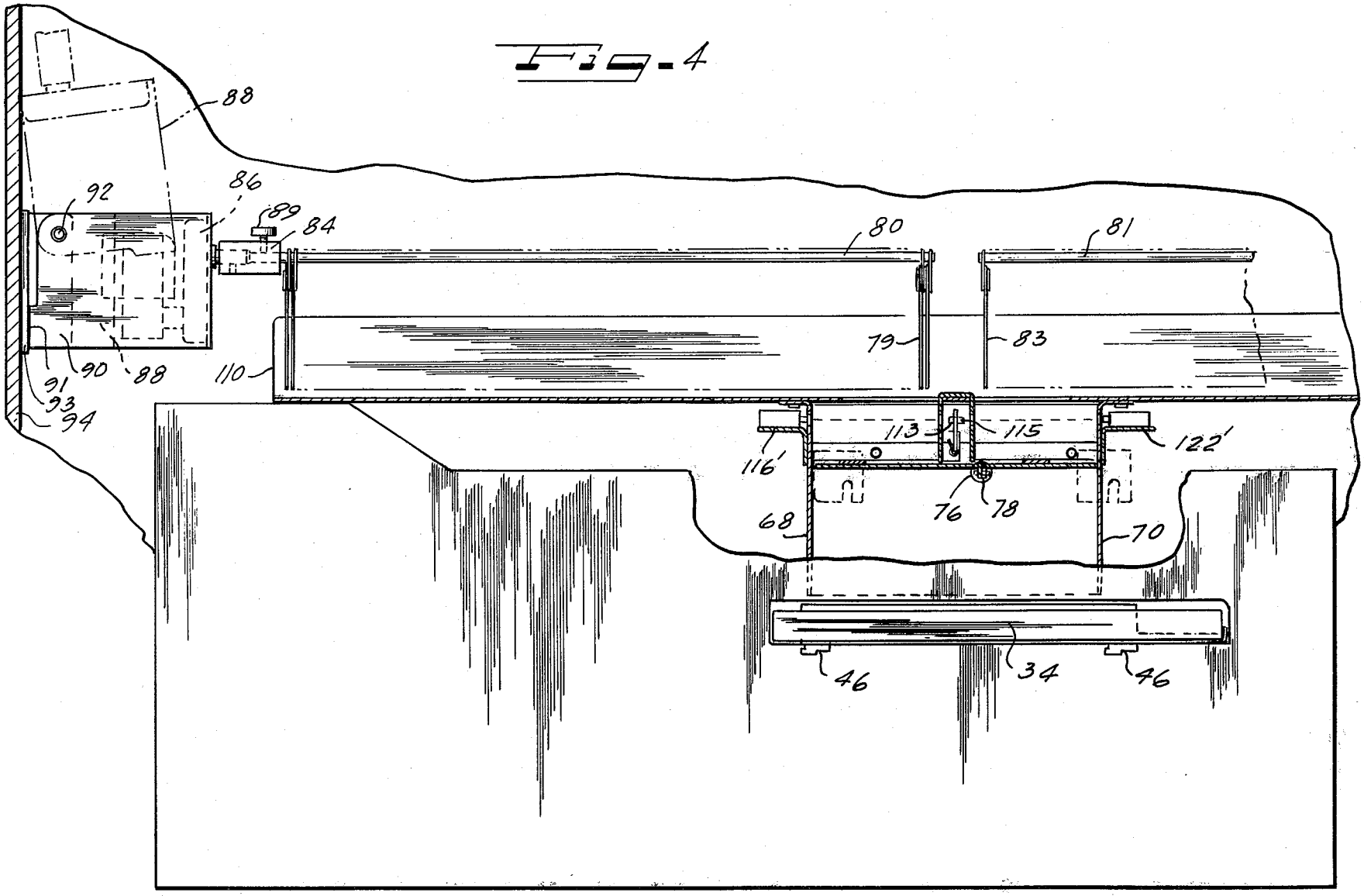
FIG. 4 is a front elevation of the magazine and dispensing portion of the apparatus of FIG. 1.

The dispensing portion 14 of the machine incorporates a magazine 60 and a can 62 interposed between the magazine 60 and the inner position of the drawer 28. FIG. 2 illustrates a side elevation of the dispensing apparatus, and FIG. 3 is a horizontal cross-section taken through FIG. 2. The can 62 is supported on the frame of the machine by means of a bracket 64', and comprises a generally rectangularly-shaped hollow body having front and rear walls 64 and 66 and side walls 68 and 70 (FIG. 3). A bracket 72 is mounted with its opposite ends secured to the front and rear walls 64 and 66, and effectively divides the can 62 into two separate halves **62*a* and 62*b* (FIG. 3). A flap 74 (FIG. 2) is mounted for rotation on a shaft 76, and the shaft 76 is received in aligned apertures in the two side walls 68 and 70. The flap 74 is normally in its upper position, which closes the top of the can 62 and prevents access to the space above the flap 74 to anyone reaching through the space between the guides for the drawer 28 from the front of the machine. A link 77 is connected to an arm 78 of the flap 74, so that the flap 72 may be raised and lowered in response to longitudinal motion of the link 77**.

Above the can 62 is located the magazine 60 for storing a plurality of packets of material to be dispensed. Each packet comprises one or more dollar bills of various denominations which are held together by a paper clip 78 made of wire or plastic. Alternatively to the use of a paper clip, a thin gripping device may be used, as long as there is a hook or aperture which can be supported by the screw 80. For simplicity, a paper clip 78 is shown without any bills in FIG. 2. The paper clips are supported by one of two screws 80 and 81, which overlie the two halves of the can 62. The end of the screw 80 overlies the half **62*a*, while the end of the screw 81 overlies the half 62*b*. Each of the packets supported by the screw 80 contain the same total quantity of money, and each of the packets supported by the screw 81 contain the same amount of money. Preferably, the amount of money in each of the packets supported by the screw 80 is different from the amount of money in each of the packets supported by the screw 81, so that two different amounts of money can be dispensed with the dispensing of a single packet from one of the two screws. For example, each of the packets supported by the screw 80 may contain a total of $20, while the packets dispensed by the screw 81** each contain $50.

The screws 80 and 81 are supported and mounted for rotation in the identical manner, and so an explanation of the screw 80 will suffice for both. Detailed views of the construction and arrangement of the screw 80 are shown in FIGS. 4–7. The end of the screw 80 opposite the free end is connected by means of a connector 84 (FIG. 4) to the shaft of a gear motor 86 which is mounted on a supporting housing 88. The housing 88 is pivotally connected to a bracket 90 by means of a pivot pin 92. The bracket 90 is secured to a side wall 94 of the dispenser unit. By means of the pivot pin 92 the housing 88 may be tilted in an upward direction, as illustrated in phantom lines in FIG. 4, When the housing 88 is thus tilted, the screw 80 is lifted into a near vertical position. This exposes the mechanism below for service. The screw 80 can be removed by turning a knob 89 secured to a set screw in the housing 88 in which the end of the screw is received. The screw is then loaded with packets, by slipping the free end of the paper clips onto the screw. When loaded, the screw is replaced in position in the housing 88 and the set screw tightened with the knob 89. When the screw 80 is fully loaded in this manner, the housing 88 is lowered into the position illustrated in FIG. 4, with a foot 91 of the housing 88 resting against a pad 93 supported on the side wall 94.

Figure 6:
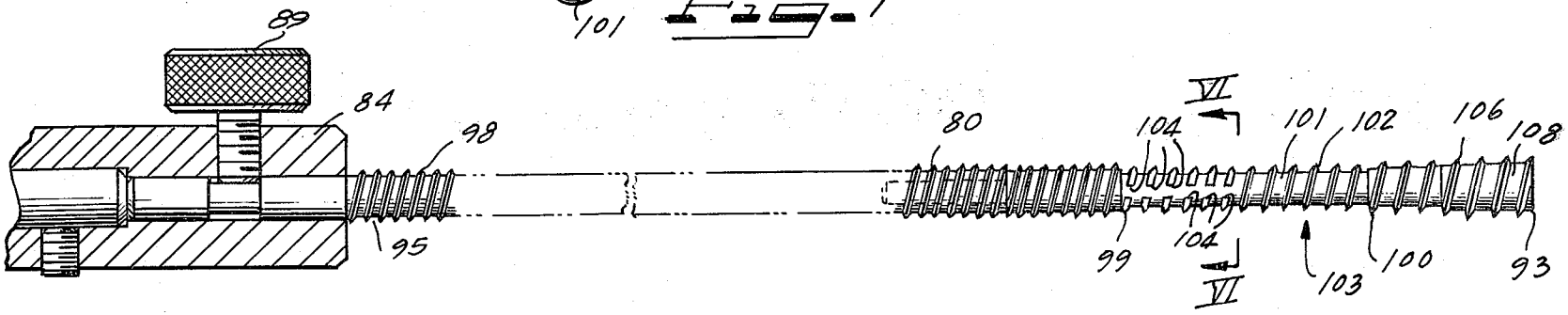
FIG. 6 is a plan view of one of the magazine screws.

The screw 80 is shown in greater detail in FIG. 6. It has a thread which is not uniform throughout the entire length of the screw, but varies in pitch at several places along the length of the screw. The major part of the length of the screw 80, extending from the inner end 95, has threads 98 of a constant pitch. In relation to the diameter of wire of which paper clips Are commonly made, a maximum of five paper clips will fit within the spaced defined by four convolutions of the thread 98.

The thread 98 extends from the inner end 95 to a junction 99. Between the junction 99 and a second junction 100, threads having a pitch 102 are provided, and the thread 102 is arranged to smoothly meet with the end of the thread 98, with only the pitch changing. The pitch of the thread 102 is somewhat less than the pitch of the thread 98, resulting in a space between adjacent convolutions of the thread 102 which could accommodate a maximum of two paper clips. The convolutions of the thread 102 are spaced apart by slightly less than the space required for two paper clips, so that if two clips occupy a space between adjacent convolutions, one or both of the clips are raised above the level of the shank 101 of the screw.

Figure 7:
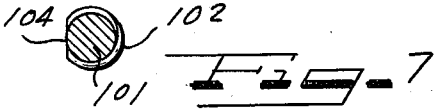
FIG. 7 is a vertical cross-section of the screw shown in FIG. 6 taken in the plane VII—VII.

A section 103 of the screw 80, illustrated in cross-sectional form in FIG. 7, has the thread 102 flattened on one side 104. Because of the flattened side 104, paper clips are separated so that only one paper clip resides between adjacent convolutions of the thread 102.

From the junction point 100 to the free end 93 of the screw 80, a thread 106 is provided, which has the same pitch as the thread 102, but gradually increases in diameter, so that the diameter of the shaft 108 on which the thread 106 is mounted gradually fills the interior space within the paper clip. The clips cannot easily pass over this portion of the screw 80, unless the screw 80 is actually rotated, and so there is little risk of a clip passing over the free end of the screw 80 due to shock or vibration. The thread 106 is only slightly larger in its outer diameter than the interior of an end of a paper clip, so the clips can easily be slipped over the end of the screw 80 during loading, with only a slight flexing of the paper clip wire.

Paper clips, together with the packets which they hold together, are advanced from the area 98 of the screw 80 to the free end 93 by rotation of the screw 80 by the motor 86. As each successive paper clip reaches the free end 93 of the screw 80, it leaves the thread 108 and is permitted to fall freely through the can 62 into the supporting surface of the drawer 28 aligned beneath it.

Although more paper clips and convolutions can reside in the area 98 of the screw 80, the flattened thread area 103 positively restricts the number of paper clips between adjacent convolutions of the thread 102 to one each. The thread flattened area 103 permits this result by allowing a paper clip which otherwise would crowd onto a convolution with another clip to retreat back toward the end 95 of the screw 80. This slipping takes place when the flat area 104 of the thread 102 has rotated to the upper part of the screw 80, as the screw turns, so that the paper clips in this area of the screw are less restricted in their longitudinal movement by a part of the thread 102. This permits the rearward slipping of the paper clip relative to the screw, and prevents more than one clip from being carried between adjacent convolutions of the thread 102. As the pitch of the thread 102 is less than that of the thread 98, turning the screw 80 always makes a space available behind a pair of clips, into which the rear clip can retreat.

Figure 5:
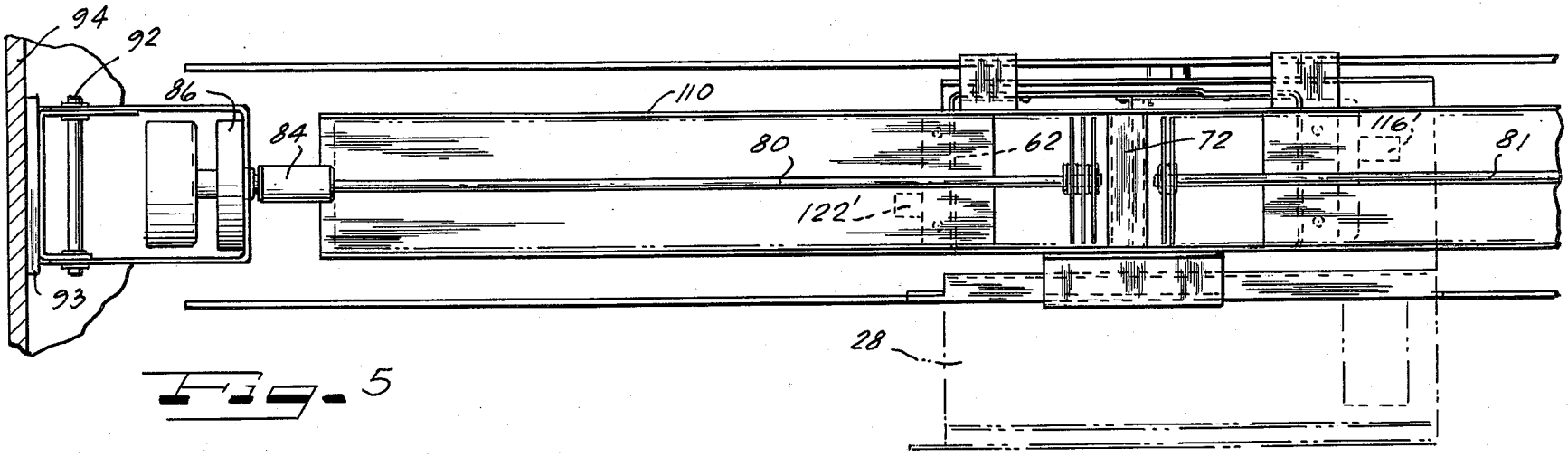
FIG. 5 is a plan view of the apparatus shown in FIG. 4.

FIG. 5 shows a plan view of the dispensing apparatus, illustrating how the end of the screws 80 and 81 are vertically aligned with the can 62 and with the inward position of the drawer 28. A U-shaped channel 110 (FIG. 2) is provided in connection with each half of the dispensing mechanism, and it underlies both of the screws 80 and 81. The size of the channel 110 is such as to accommodate the packets supported from the screws 80 and 81 and maintain them in generally ordered arrangement, preventing any tendency of the packets to rotate with the screw instead of being transported longitudinally. A rectangular opening is provided in the bottom wall of the channel 110 in alignment with each half of the can 62, to allow the packets to drop through the can 62 onto the upper surface of the drawer 28.

As the packets drop through the can 62, they are detected by a photosensitive element which responds to the passage of a packet falling from the magazine through either section of the can 62. To this end, a pair of apertures 112 and 114 are provided (FIG. 3) in the end walls 68 and 70 of the can 62, and apertures 116 and 118 are provided in the separating bracket 72. The apertures 112 and 116 are aligned, and the apertures 114 and 118 are aligned, but the alignment of the two pairs of apertures is offset so that each pair of apertures is aligned with one of two independent light beams which are interrupted by passage of a packet downwardly through the can 62. A shelf 116' is mounted on the outside of the wall 68 of the can just below the aperture 112, and serves to support a light bulb or other light source (not shown). When energized the light bulb shines a beam of light through the apertures 112 and 116. The light beam is detected by a photosensitive device 113 mounted on the U-shaped bracket 72. A second photosensitive device 115 is disposed on the other side of the bracket 72 in alignment with the apertures 114 and 118. The latter responds to a beam of light produced by a light bulb supported on a shelf 122 below the aperture 114, which light extends through the apertures 114 and 118.

As more fully described hereinafter, the interruption of the light beams by a falling packet of money signals that a packet of cash has dropped and that the drawer 28 may be returned to its outer position, where the cash which has dropped into the drawer is made available to the operator.

When the packet drops through the can 62, the flap 74 (FIG. 2) is lowered by operation of the link 77. The link 77 is moved longitudinally by a solenoid or other similar device (not shown) at the appropriate time when the drawer 28 is in its inner position, and the machine has been made ready to dispense a packet from the magazine. Alternatively, the flap 74 may be connected to the drawer or to its linkage by a spring or the like so that merely movement of the drawer 28 towards its inner position is sufficient to cause the flap 74 to open. In any event, the flap 74 is always closed when the drawer 28 is in its outer position, to maintain the security of the magazine 60.

Figure 8:
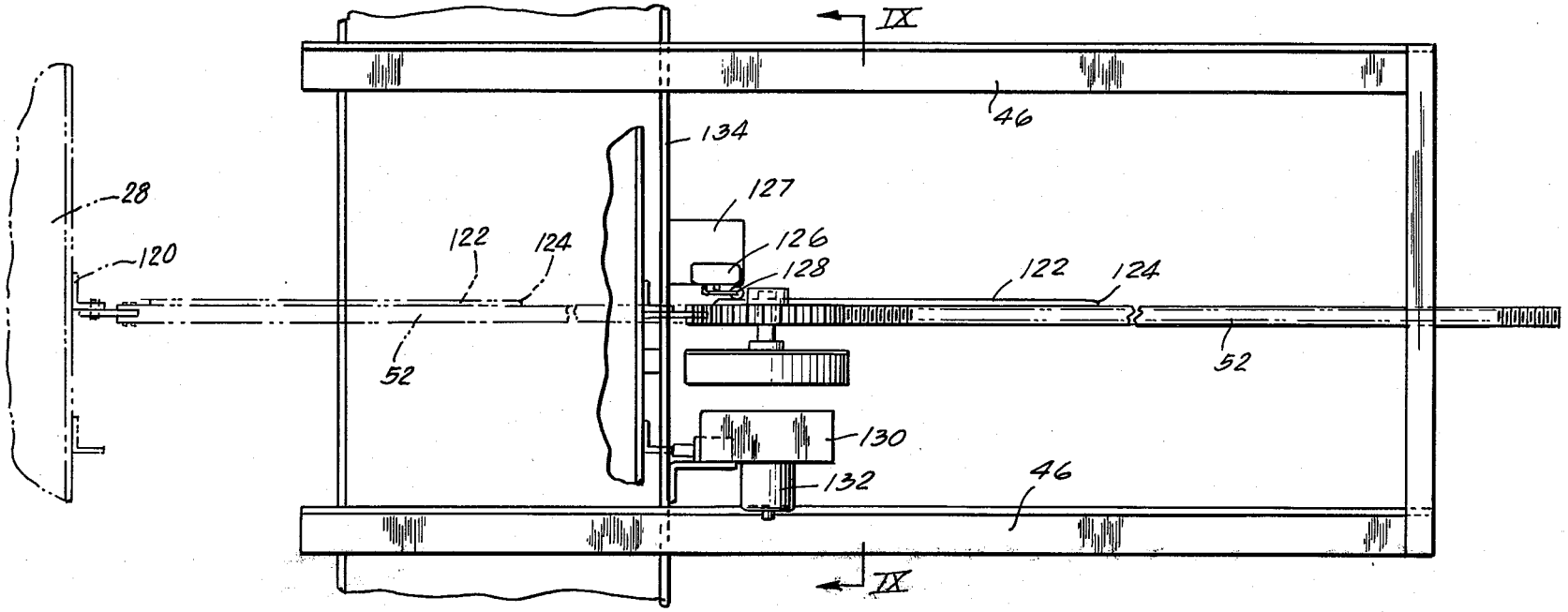
FIG. 8 is a plan view of the drive assembly for the drawer of the dispensing machine.

Referring now to FIG. 8, a plan view of the drawer operating mechanism is illustrated. The drawer is shown in its rearward position in full-lined form and in its extended position in dashed lines.

Figure 9:
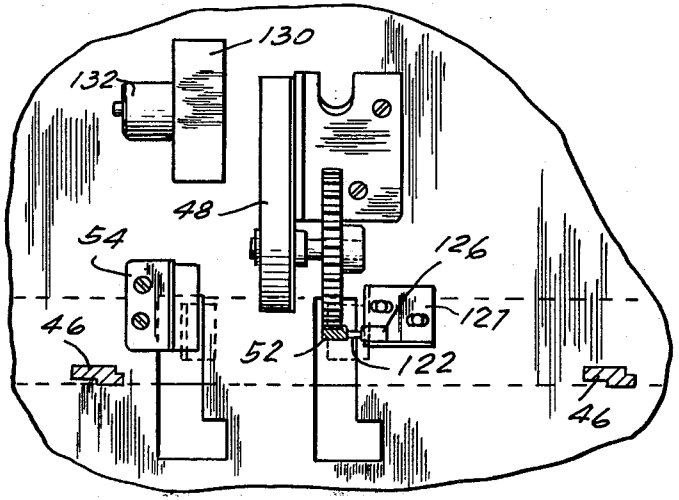
FIG. 9 is a side elevation of a portion of the apparatus illustrated in FIG. 8 taken in the plane IX—IX.

The rear end of the drawer 28 has a bracket 120 secured thereto, and the rack 52 is secured to the bracket 120. A cam plate 122 is secured to a side of the rack 52. The cam plate 122 is formed of a piece of relativey thin material secured to the side of the rack 52. The plate 122 has its rearward end 124 spaced a predetermined distance behind the drawer 28. A miniature-type switch 126 having its operator controlled by a lever with a roller 128 at its free end is supported on a bracket 127 so that the roller 128 rolls along the side of the rack 52 as it moves forwardly and backwardly, and along the surface of the cam plate 122, when its end 124 is behind the position of the roller 128. The switch 126 closes when the drawer 28 is pushed inwardly to a position at which the wall 34 underlies the guide 40, as noted above, and the end 124 of the cam plate 122 is adjacent the switch 126 at this point, so that the switch 126 closes when the drawer 28 has been pushed in to this point. The closing of the switch 126 initiates operation of the motor 48, to drive the rack 52 rearwardly so as to pull the drawer 28 fully to its inward position. FIG. 9, which is an end elevation of a portion of the drive mechanism, shows the switch 126 in association with the rack 52 and the cam plate 122 supported thereon.

A blower 130, driven by a motor 132, is mounted on a vertical wall 134 (FIG. 1) associated with dispensing apparatus, and blows air through an aperture in the wall 134. This effectively keeps the air within the can 62 agitated so that the packets which are dispensed by turning the screw 80 fall into the tray 28 without any possible hangup.

Figure 10:
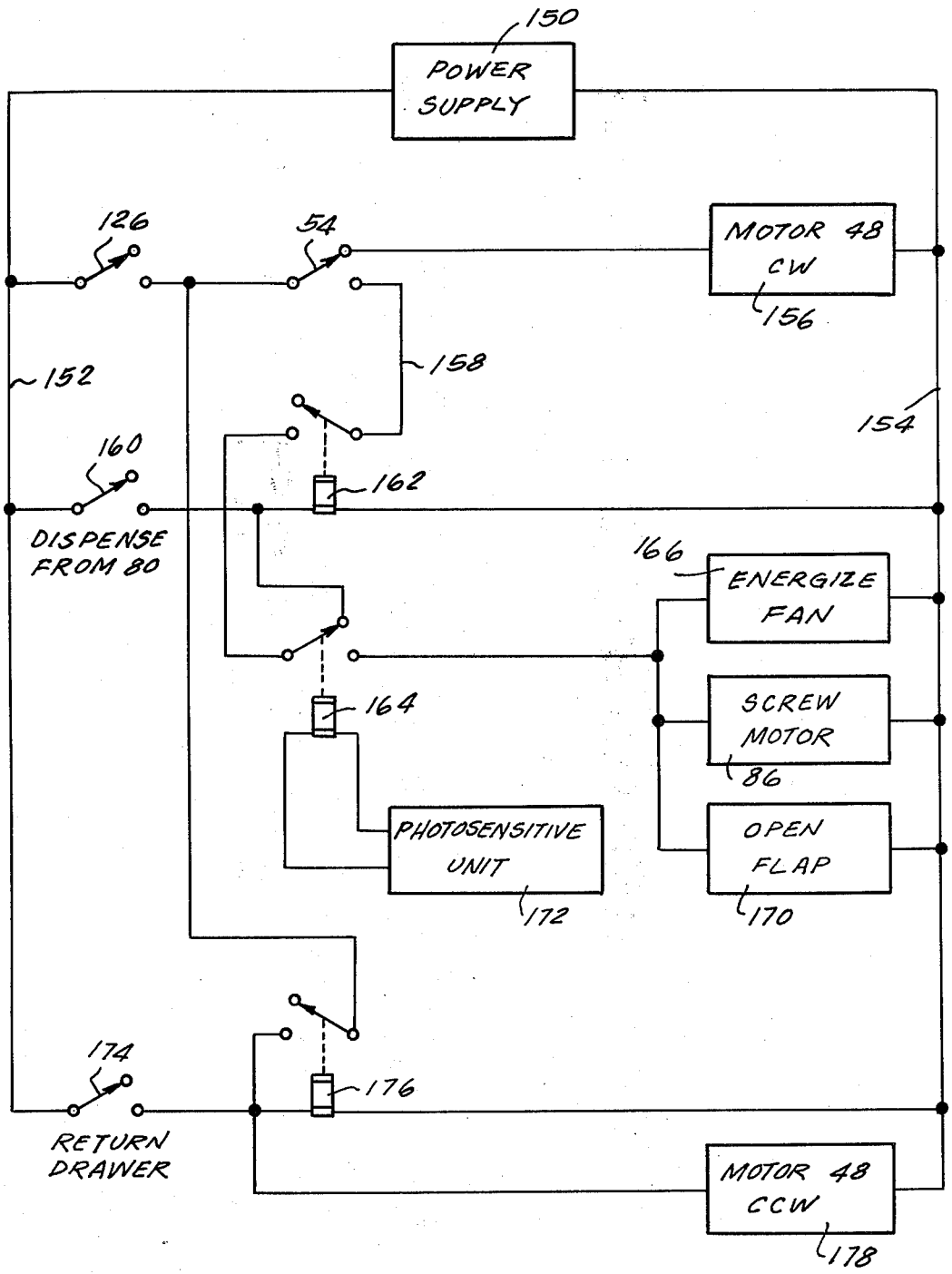
FIG. 10 is a schematic diagram, partly in functional block diagram form, of a portion of the control system of a dispensing machine incorporating the present invention.

FIG. 10 shows a portion of the control system of a dispensing machine incorporating the present invention. A power supply 150 provides an electrical potential difference between supply lines 152 and 154. When the drawer 28 is pushed in so that the cam switch 126 is closed, power is supplied through the limit switch 54 to a unit 156 which energizes the motor 48 to turn in a clockwise direction, to move the tray 28 to its packet-receiving position. When that position is reached, the switch 54 is operated to its other position, supplying power to a line 158. When a switch 160 is momentarily closed by the control system, in response to correct entry by the operator of data into the keyboard 20 (FIG. 1), a relay 162 is energized, and held in through the normally closed contacts of a relay 164.

While the relay 162 is operated, unit 166 energizes the fan 130, a screw motor 68 is energized, and unit 170 energizes a solenoid or other means for opening the flap 74. The selected screw turns until the drop of a packet is recognized by a photosensitive unit 172, which momentarily operates the relay 164 to remove power from the relay 162 and the units 166–170. Thereafter, when a switch 174 is momentarily closed, power is applied to a relay 176, provided the cam switch 126 remains closed, which holds itself energized through its normally open contact, and power is also applied to a unit 178 which energizes the motor 48 to rotate in a counterclockwise direction until the switch 126 opens. Another switch (not shown) like the switch 160 is provided for energizing the motor for the other screw, which remains energized until its associated photosensitive device registers the drop of a packet. The fan is energized and the flap is open while either screw motor is energized.

It will be appreciated that although the present invention has been described particularly in relation to a cash dispensing machine, it is not necessarily restricted to that use. It may be used to dispense any packets or articles which can be hung on hooks, and when so used, the hooks are hung on the screws 80 and 81. When the packets or articles are light enough, such as packets of money, paper clips are conveniently used as the hooks.

The apparatus of the present invention, when used in a cash dispensing machine, can conveniently be combined with functions which permit the making of deposits. In this connection the drawer 28 may be used to receive deposit receipts prepared by equipment (not shown) within the unit, and make such deposit receipts available to the operator. Deposit receiving and acknowledging equipment is well known and therefore need not be specifically described herein. Any of a variety of such apparatus may be used.

From the foregoing description it will be appreciated that the present invention furnishes a simple and economical arrangement for storing and dispensing packets or articles. The magazine is loaded quickly and easily simply by tipping the screws 80 and 81 upwardly and slipping a quantity of packets onto them, without the need for any special measure to ensure even spacing of the packets. However, they are loaded, rotation of the screws causes them to be dropped one at a time into the drawer 28, with the screw 80 (or the screw 81) rotating continuously until the photosensitive device detects the dropping of a packet, and thereafter immediately stopping rotation of the screw, so that only one packet is dispensed. The drawer arrangement effects a positive drive for movement of the drawer between its inner and outer positions, with no danger to the operator's fingers. And the spring biasing of the drawer towards its outer position prevents any hang up of the drawer in an intermediate position.

Complete security for the contents of the magazine is provided at all times, and so there is no danger of unauthorized entry or theft through the drawer opening.

Various modifications and additions can be made to the apparatus of the present invention without departing from the essential features of novelty thereof, which are intended to be defined and secured by the appended claims.

What is claimed is:

1. In a magazine assembly for a dispensng machine, the combination comprising a screw having a helical thread, a plurality of separate articles hung by hangers from said screw, supporting means for supporting said screw at one end for rotation, with the opposite end of said screw located above an article receiving area, said thread having a first portion with a continuous thread in which adjacent convolutions of said thread are spaced apart by a first distance, and a second portion, coaxial said first portion and interposed between said first portion and said opposite end, said second portion having a thread which meets smoothly with the thread of said first portion and in which adjacent convolutions of the thread are spaced apart by a distance greater than said first distance, said thread having the same handedness in both said first and second portions, some of the convolutions of said second portion being flattened on one side to enable a separation of said hangers so that a maximum of one hanger resides between adjacent convolutions of said opposite end.

2. Apparatus according to claim 1, wherein said thread has a third portion, between said second portion and said opposite end, the shank of said screw being enlarged toward said opposite end within said third portion, with the radius of the shank at said opposite end being approximately equal to the radius of curvature at a surface of said hanger which is supported by said screw.

3. Apparatus according to claim 2 wherein each of said hangers has a curved portion extending around said screw and adapted to be juxtaposed with the shank of said screw at opposite sides thereof near said opposite end, said thread at said opposite end being only slightly larger than said shank, whereby said hangers can be loaded onto said opposite end by rectilinear movement in the axial direction, said hangers being resiliently deformed temporarily as they pass over said third portion during loading.

4. Apparatus according to claim 1, wherein said hangers comprise paper clips.

5. Apparatus according to claim 1, wherein said supporting means includes pivot means, whereby said screw may be pivoted upwardly about a horizontal axis.

6. Apparatus according to claim 1, including a motor for rotating said screw, and including photosensitive means disposed below said opposite end for detecting the dropping of an article from said screw.

7. Apparatus according to claim 6, including means responsive to said photosensitive means for deactivating said motor in response to detection of a dropped article.

8. Apparatus according to claim 1, including a drawer movable between an outer position and an inner position, said inner position being located at said article receiving area, whereby articles dropped from said screw are received by said drawer at its inner position.

9. Apparatus according to claim 8, including a can interposed between said screw and said drawer, said can having a vertical tubular body and a hinged flap normally closing the top of said can, and means for moving said flap to open the top of said can when said drawer is in its inner position.

10. Apparatus according to claim 9, including fan means mounted in fixed relation to said can for agitating the air beneath said screw.

11. Apparatus according to claim 1 wherein the threads of said first portion are spaced such that a maximum of five hangers can be supported within four convolutions of said helix.

12. Apparatus according to claim 1 wherein the convolutions of said second portion are spaced by a distance slightly less than the thickness of two of said hangers.

* * * * *